United States Patent [19]

Puhak

[11] 3,947,715

[45] Mar. 30, 1976

[54] FAST WARM UP CATHODE FOR A CATHODE RAY TUBE

[75] Inventor: Peter George Puhak, Seneca Falls, N.Y.

[73] Assignee: GTE Sylvania Incorporated, Stamford, Conn.

[22] Filed: June 10, 1975

[21] Appl. No.: 585,707

[52] U.S. Cl. ..... 313/270; 313/37; 313/337; 313/346 R; 313/451

[51] Int. Cl.[2] ..... H01J 1/94; H01J 19/48

[58] Field of Search ..... 313/337, 270, 346, 30, 313/37, 42, 46, 383, 390, 451

[56] References Cited

UNITED STATES PATENTS

| | | | |
|---|---|---|---|
| 2,206,504 | 7/1940 | Kinyon | 313/270 |
| 2,421,767 | 6/1947 | Varian | 313/270 X |
| 2,833,952 | 5/1958 | Hemphill | 313/270 X |
| 3,273,003 | 9/1966 | Dietrich | 313/337 X |
| 3,333,138 | 7/1967 | Szegho | 313/270 |
| 3,772,559 | 11/1973 | Schoke | 313/356 |
| 3,881,124 | 4/1975 | Buescher | 313/37 |

*Primary Examiner*—Saxfield Chatmon, Jr.
*Attorney, Agent, or Firm*—Norman J. O'Malley; William H. McNeill; Robert T. Orner

[57] ABSTRACT

A fast warm up cathode comprises a substantially cup-shaped top cap and a hollow cylindrical sleeve axially displaced from the top cap. Means are provided for joining the sleeve and the top cap into an integral unit. The means comprise a plurality of individual rod-like members having extremities substantially flat for attachment to the top cap and the sleeve. The plurality of rod-like members are equally spaced about the periphery of the sleeve and the top cap.

4 Claims, 5 Drawing Figures

FAST WARM UP CATHODE FOR A CATHODE RAY TUBE

BACKGROUND OF THE INVENTION

This invention generally relates to cathodes for cathode ray tubes and more particularly to fast warm up cathodes therefor. The fast warm up cathodes are designed to provide a warm up time of between four and six seconds. This warm up time is to achieve sufficient electron flow capability from the cathode to provide a viewable raster on the screen of a cathode ray tube.

Prior art cathodes of this type have been fabricated as two-part elements. A first element comprises a substantially cupshaped top cap, the closed end of which would be provided with an electron emissive material. A sleeve portion which is hollow and cylindrical and generally elongated in comparison to the length of the top cap has been provided with cut-out portions providing tabs which provide a minimum area contact means for attachment to the top cap. The top cap and the sleeve have been fabricated from relatively thin material; that is in the area of 3 to 6 thousandths of an inch thick. Problems have arisen in the manufacture of this type of cathode because of the flimsiness of the attachment portions formed in the cathode sleeve. It has been extremely difficult to mass produce these cathodes in any given quantity. Accordingly, it would be an advance in the art if a suitable cathode of this general description could be provided that had greater rigidity and greater ease of fabrication.

OBJECTS AND SUMMARY OF THE INVENTION

It is therefore an object of this invention to obviate the disadvantages of the prior art.

It is another object of the invention to enhance the manufacturability of fast warm up cathodes.

It is another object of the invention to provide a fast warm up cathode that contains a plurality of broadened attachment members which are formed to facilitate welding or other attachment to the top-cap and sleeve and further provide a simplified egress for the heater to be inserted therein.

These objects are accomplished in one aspect of the invention by the provision of a fast warm up cathode for a cathode ray tube which comprises a substantially cup-shaped top cap and a hollow cylindrical sleeve axially separated therefrom. The longitudinal axial dimension of the sleeve in this instance is approximately equal to that of the top cap. A plurality of means are provided for attachment to the cap and stack to form an integral unit. The means comprise a plurality of individual rod-like members having their extremities providing substantially flat attachment surfaces to connect the axially displaced top cap and sleeve. A cathode formed in accordance with the above provides all of the advantages of the hitherto known fast warm up cathodes and in addition, it is readily manufacturable by mass production techniques.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

Figure 1:
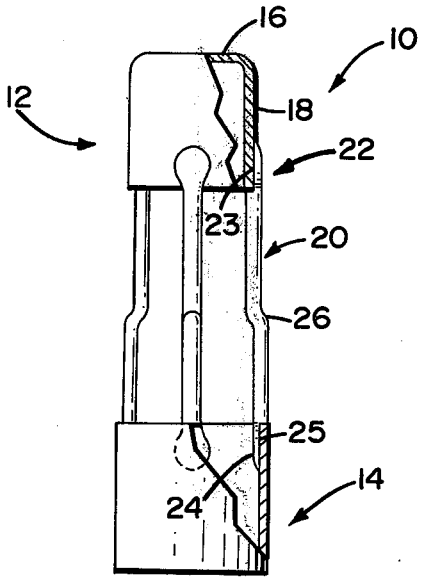
FIG. 1 is an elevational side view of a cathode constructed in accordance with this invention with some areas broken away for purposes of clarity.

Referring now to the drawings with greater particularity, there is shown a fast warm up cathode 10 in FIG. 1. Cathode 10 comprises a top cap 12 and a hollow cylindrical sleeve 14 which is longitudinally axially displaced from top cap 12. The top cap 12 is substantially cup-shaped and has a closed portion 16 and a peripheral sidewall 18. The sleeve 14 has a diameter slightly larger than the diameter of the top cap 12. A plurality of individual rod-like members 20 connect the top cap and the sleeve. Rod-like members 20 have their extremities 22 and 24 respectively provided with substantially flat attachment surfaces 23 and 25 for attachment to the top cap 12 and sleeve 14.

Further, the members 20 have an offset portion 26 formed intermediate the extremities. The flattened surfaces 23 and 25 of the extremities are formed on opposite sides of the members 20 and in a plane normal to the offset 26. This construction allows for compensation of the different diameters between the sleeve 14 and the top cap 12. That is, the flattened surface 23 which is formed at extremity 22 contacts the outer surface of sidewall 18 of top cap 12 while the flattened surface 25 of extremity 24 engages the inner surface of sleeve 14. The offset 26 in this instance forms an inwardly extending portion of member 20 and facilitates the insertion of a heater (not shown) thereinto.

Figure 3:
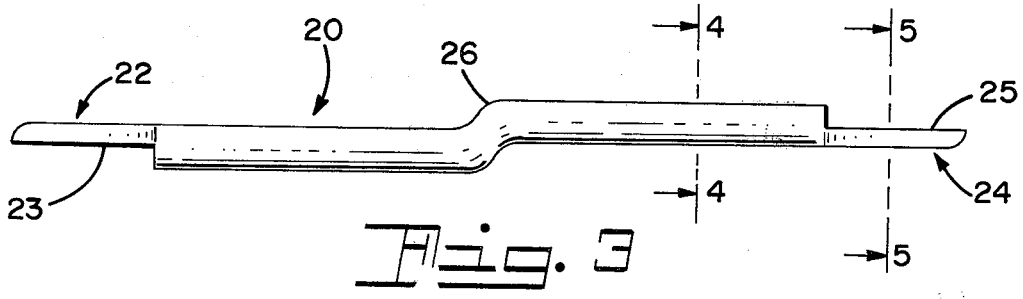
FIG. 3 is a side elevational view of one type of rod-like connecting member.
Figure 4:
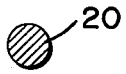
FIG. 4 is a section taken along the line 4—4 of FIG. 3.
Figure 5:
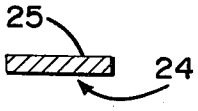
FIG. 5 is a sectional view taken along the line 5—5 of FIG. 3.
Figure 2:
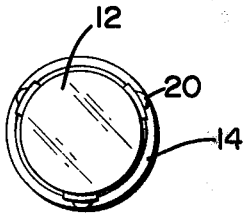
FIG. 2 is a plan view of the cathode of FIG. 1.

Rod-like member 20 is shown in greater particularity in FIG. 3 as being substantially cylindrical. The extremities 22 and 24 can be formed to provide flat surfaces 23 and 25 by a coining operation. This will inherently provide a surface that is substantially wider than the diameter of member 20 as can be seen in the sectional view of FIG. 4 and FIG. 5.

As shown in the illustration, at least three broad like members 20 are provided equally spaced about the periphery of the top cap and the sleeve. While more members 20 could be utilized, it is believed that the minimum number which will suffice for suitable support will provide the least amount of heat loss, which is of course a critical element in any fast warm up cathode.

While rod-like member has been shown in this instance as having a substantially circular cross section, and this is the preferred embodiment, other cross sectional materials could be utilized; for example, square or rectangular. When such other constructions are utilized, however, it would be advisable to provide a sufficient radii on the various corners of the members 20 to provide for smooth insertion of the heater element into the cathode.

Also, while flattened areas 23 and 25 have been described as being formed by coining, it will be apparent that they could be formed by grinding or other methods.

While there have been shown what are at present considered to be the preferred embodiments of the invention, it will be apparent to those skilled in the art that various changes and modifications can be made herein without departing from the scope of the invention as defined by the appended claims.

What is claimed is:

1. A fast warm-up cathode for a cathode ray tube comprising: a substantially cup-shaped top cap; a hollow cylindrical sleeve longitudinally axially separated from said top cap; and means joining said sleeve and said top cap into an integral unit, said means comprising a plurality of individual rod-like members having extremities providing substantially flat attachment surfaces for said sleeve and said top cap.

2. The cathode of claim 1 wherein said members are cylindrical in cross-section and said extremities are coined to provide said substantially flat, widened surface.

3. The cathode of claim 1 wherein said sleeve has a larger diameter than said top cap and said members have an offset formed intermediate said extremities, said offset compensating for the differences in said diameters.

4. The cathode of claim 3 wherein said substantially flat surfaces are formed by coining opposite sides of said members and fit respectively on the inside of said sleeve and the outside of said top cap.

* * * * *